US007791291B2

(12) United States Patent
Gorrell

(10) Patent No.: US 7,791,291 B2
(45) Date of Patent: Sep. 7, 2010

(54) DIAMOND FIELD EMISSION TIP AND A METHOD OF FORMATION

(75) Inventor: Jonathan Gorrell, Melrose, FL (US)

(73) Assignee: Virgin Islands Microsystems, Inc., St. Thomas, VI (US)

( * ) Notice: Subject to any disclaimer, the term of this patent is extended or adjusted under 35 U.S.C. 154(b) by 728 days.

(21) Appl. No.: 11/418,263

(22) Filed: May 5, 2006

(65) Prior Publication Data

US 2007/0075326 A1 Apr. 5, 2007

Related U.S. Application Data

(63) Continuation-in-part of application No. 11/238,991, filed on Sep. 30, 2005.

(51) Int. Cl.
*H05H 7/00* (2006.01)

(52) U.S. Cl. ..... 315/501; 315/505; 315/506

(58) Field of Classification Search ..... 315/500–507, 315/5.43, 5.34–5.36, 5.39, 5.41; 250/396 R, 250/423 R, 493.1, 495.1, 397
See application file for complete search history.

(56) References Cited

U.S. PATENT DOCUMENTS

| | | | |
|---|---|---|---|
| 1,948,384 | A | 2/1934 | Lawrence |
| 2,307,086 | A | 1/1943 | Varian et al. |
| 2,431,396 | A | 11/1947 | Hansell |
| 2,473,477 | A | 6/1949 | Smith |
| 2,634,372 | A | 4/1953 | Salisbury |
| 2,932,798 | A | 4/1960 | Kerst et al. |
| 2,944,183 | A | 7/1960 | Drexler |
| 2,966,611 | A | 12/1960 | Sandstrom |
| 3,231,779 | A | 1/1966 | White |
| 2,397,905 | A | 1/1967 | Rockwell et al. |
| 3,297,905 | A | 1/1967 | Rockwell et al. |
| 3,315,117 | A | 4/1967 | Udelson |
| 3,387,169 | A | 6/1968 | Farney |
| 3,543,147 | A | 11/1970 | Kovarik |
| 3,546,524 | A | 12/1970 | Stark |
| 3,560,694 | A | 2/1971 | White |
| 3,571,642 | A | 3/1971 | Westcott |
| 3,586,899 | A | 6/1971 | Fleisher |
| 3,761,828 | A | 9/1973 | Pollard et al. |
| 3,886,399 | A | 5/1975 | Symons |
| 3,923,568 | A | 12/1975 | Bersin |

(Continued)

FOREIGN PATENT DOCUMENTS

| | | |
|---|---|---|
| EP | 0237559 B1 | 12/1991 |

(Continued)

OTHER PUBLICATIONS

Search Report and Written Opinion mailed Apr. 23, 2008 in PCT Appln. No. PCT/US2006/022678.

(Continued)

*Primary Examiner*—Douglas W Owens
*Assistant Examiner*—Tung X Le
(74) *Attorney, Agent, or Firm*—Davidson Berquist Jackson & Gowdey LLP

(57) ABSTRACT

A diamond field emission tip and methods of forming such diamond field emission tips, for use with cathodes that will act as a source of and emit beams of charged particles.

22 Claims, 10 Drawing Sheets

U.S. PATENT DOCUMENTS

| | | | |
|---|---|---|---|
| 3,989,347 | A | 11/1976 | Eschler |
| 4,053,845 | A | 10/1977 | Gould |
| 4,282,436 | A | 8/1981 | Kapetanakos |
| 4,450,554 | A | 5/1984 | Steensma et al. |
| 4,453,108 | A | 6/1984 | Freeman, Jr. |
| 4,482,779 | A | 11/1984 | Anderson |
| 4,528,659 | A | 7/1985 | Jones, Jr. |
| 4,589,107 | A | 5/1986 | Middleton et al. |
| 4,598,397 | A | 7/1986 | Nelson et al. |
| 4,630,262 | A | 12/1986 | Callens et al. |
| 4,652,703 | A | 3/1987 | Lu et al. |
| 4,661,783 | A | 4/1987 | Gover et al. |
| 4,704,583 | A | 11/1987 | Gould |
| 4,712,042 | A | 12/1987 | Hamm |
| 4,713,581 | A | 12/1987 | Haimson |
| 4,727,550 | A | 2/1988 | Chang et al. |
| 4,740,963 | A | 4/1988 | Eckley |
| 4,740,973 | A | 4/1988 | Madey |
| 4,746,201 | A | 5/1988 | Gould |
| 4,761,059 | A | 8/1988 | Yeh et al. |
| 4,782,485 | A | 11/1988 | Gollub |
| 4,789,945 | A | 12/1988 | Niijima |
| 4,806,859 | A | 2/1989 | Hetrick |
| 4,809,271 | A | 2/1989 | Kondo et al. |
| 4,813,040 | A | 3/1989 | Futato |
| 4,819,228 | A | 4/1989 | Baran et al. |
| 4,829,527 | A | 5/1989 | Wortman et al. |
| 4,838,021 | A | 6/1989 | Beattie |
| 4,841,538 | A | 6/1989 | Yanabu et al. |
| 4,864,131 | A | 9/1989 | Rich et al. |
| 4,866,704 | A | 9/1989 | Bergman |
| 4,866,732 | A | 9/1989 | Carey et al. |
| 4,873,715 | A | 10/1989 | Shibata |
| 4,887,265 | A | 12/1989 | Felix |
| 4,890,282 | A | 12/1989 | Lambert et al. |
| 4,898,022 | A | 2/1990 | Yumoto et al. |
| 4,912,705 | A | 3/1990 | Paneth et al. |
| 4,932,022 | A | 6/1990 | Keeney et al. |
| 4,981,371 | A | 1/1991 | Gurak et al. |
| 5,023,563 | A | 6/1991 | Harvey et al. |
| 5,036,513 | A | 7/1991 | Greenblatt |
| 5,065,425 | A | 11/1991 | Lecomte et al. |
| 5,113,141 | A | 5/1992 | Swenson |
| 5,121,385 | A | 6/1992 | Tominaga et al. |
| 5,127,001 | A | 6/1992 | Steagall et al. |
| 5,128,729 | A | 7/1992 | Alonas et al. |
| 5,130,985 | A | 7/1992 | Kondo et al. |
| 5,150,410 | A | 9/1992 | Bertrand |
| 5,155,726 | A | 10/1992 | Spinney et al. |
| 5,157,000 | A | 10/1992 | Elkind et al. |
| 5,163,118 | A | 11/1992 | Lorenzo et al. |
| 5,185,073 | A | 2/1993 | Bindra |
| 5,187,591 | A | 2/1993 | Guy et al. |
| 5,199,918 | A | 4/1993 | Kumar |
| 5,214,650 | A | 5/1993 | Renner et al. |
| 5,233,623 | A | 8/1993 | Chang |
| 5,235,248 | A | 8/1993 | Clark et al. |
| 5,262,656 | A | 11/1993 | Blondeau et al. |
| 5,263,043 | A | 11/1993 | Walsh |
| 5,268,693 | A | 12/1993 | Walsh |
| 5,268,788 | A | 12/1993 | Fox et al. |
| 5,282,197 | A | 1/1994 | Kreitzer |
| 5,283,819 | A | 2/1994 | Glick et al. |
| 5,293,175 | A | 3/1994 | Hemmie et al. |
| 5,302,240 | A | 4/1994 | Hori et al. |
| 5,305,312 | A | 4/1994 | Fornek et al. |
| 5,341,374 | A | 8/1994 | Lewen et al. |
| 5,354,709 | A | 10/1994 | Lorenzo et al. |
| 5,446,814 | A | 8/1995 | Kuo et al. |
| 5,504,341 | A | 4/1996 | Glavish |
| 5,578,909 | A | 11/1996 | Billen |
| 5,604,352 | A | 2/1997 | Schuetz |
| 5,608,263 | A | 3/1997 | Drayton et al. |
| 5,637,966 | A * | 6/1997 | Umstadter et al. ..... 315/507 |
| 5,663,971 | A | 9/1997 | Carlsten |
| 5,666,020 | A | 9/1997 | Takemura |
| 5,668,368 | A | 9/1997 | Sakai et al. |
| 5,705,443 | A | 1/1998 | Stauf et al. |
| 5,737,458 | A | 4/1998 | Wojnarowski et al. |
| 5,744,919 | A | 4/1998 | Mishin et al. |
| 5,757,009 | A | 5/1998 | Walstrom |
| 5,767,013 | A | 6/1998 | Park |
| 5,780,970 | A | 7/1998 | Singh et al. |
| 5,790,585 | A | 8/1998 | Walsh |
| 5,811,943 | A | 9/1998 | Mishin et al. |
| 5,821,836 | A | 10/1998 | Katehi et al. |
| 5,821,902 | A | 10/1998 | Keen |
| 5,825,140 | A | 10/1998 | Fujisawa |
| 5,831,270 | A | 11/1998 | Nakasuji |
| 5,847,745 | A | 12/1998 | Shimizu et al. |
| 5,889,449 | A | 3/1999 | Fiedziuszko |
| 5,889,797 | A | 3/1999 | Nguyen |
| 5,902,489 | A | 5/1999 | Yasuda et al. |
| 5,963,857 | A | 10/1999 | Greywall |
| 5,972,193 | A | 10/1999 | Chou et al. |
| 6,005,347 | A | 12/1999 | Lee |
| 6,008,496 | A | 12/1999 | Winefordner et al. |
| 6,040,625 | A | 3/2000 | Ip |
| 6,060,833 | A | 5/2000 | Velazco |
| 6,080,529 | A | 6/2000 | Ye et al. |
| 6,117,784 | A | 9/2000 | Uzoh |
| 6,139,760 | A | 10/2000 | Shim et al. |
| 6,180,415 | B1 | 1/2001 | Schultz et al. |
| 6,195,199 | B1 | 2/2001 | Yamada |
| 6,222,866 | B1 | 4/2001 | Seko |
| 6,278,239 | B1 | 8/2001 | Caporaso et al. |
| 6,281,769 | B1 | 8/2001 | Fiedziuszko |
| 6,297,511 | B1 | 10/2001 | Syllaios et al. |
| 6,301,041 | B1 | 10/2001 | Yamada |
| 6,309,528 | B1 | 10/2001 | Taylor et al. |
| 6,316,876 | B1 | 11/2001 | Tanabe |
| 6,338,968 | B1 | 1/2002 | Hefti |
| 6,370,306 | B1 | 4/2002 | Sato et al. |
| 6,373,194 | B1 | 4/2002 | Small |
| 6,376,258 | B2 | 4/2002 | Hefti |
| 6,407,516 | B1 | 6/2002 | Victor |
| 6,441,298 | B1 | 8/2002 | Thio |
| 6,448,850 | B1 | 9/2002 | Yamada |
| 6,453,087 | B2 | 9/2002 | Frish et al. |
| 6,470,198 | B1 | 10/2002 | Kintaka et al. |
| 6,504,303 | B2 | 1/2003 | Small |
| 6,525,477 | B2 | 2/2003 | Small |
| 6,534,766 | B2 | 3/2003 | Abe et al. |
| 6,545,425 | B2 | 4/2003 | Victor |
| 6,552,320 | B1 | 4/2003 | Pan |
| 6,577,040 | B2 | 6/2003 | Nguyen |
| 6,580,075 | B2 | 6/2003 | Kametani et al. |
| 6,603,781 | B1 | 8/2003 | Stinson et al. |
| 6,603,915 | B2 | 8/2003 | Glebov et al. |
| 6,624,916 | B1 | 9/2003 | Green et al. |
| 6,636,185 | B1 | 10/2003 | Spitzer et al. |
| 6,636,534 | B2 | 10/2003 | Madey et al. |
| 6,636,653 | B2 | 10/2003 | Miracky et al. |
| 6,640,023 | B2 | 10/2003 | Miller et al. |
| 6,642,907 | B2 | 11/2003 | Hamada et al. |
| 6,687,034 | B2 | 2/2004 | Wine et al. |
| 6,700,748 | B1 | 3/2004 | Cowles et al. |
| 6,724,486 | B1 | 4/2004 | Shull et al. |
| 6,738,176 | B2 | 5/2004 | Rabinowitz et al. |
| 6,741,781 | B2 | 5/2004 | Furuyama |
| 6,777,244 | B2 | 8/2004 | Pepper et al. |
| 6,782,205 | B2 | 8/2004 | Trisnadi et al. |
| 6,791,438 | B2 | 9/2004 | Takahashi et al. |
| 6,800,877 | B2 | 10/2004 | Victor et al. |

6,801,002 B2 10/2004 Victor et al.
6,819,432 B2 11/2004 Pepper et al.
6,829,286 B1 12/2004 Guilfoyle et al.
6,834,152 B2 12/2004 Gunn et al.
6,870,438 B1 3/2005 Shino et al.
6,871,025 B2 3/2005 Maleki et al.
6,885,262 B2 4/2005 Nishimura et al.
6,900,447 B2 5/2005 Gerlach et al.
6,909,092 B2 6/2005 Nagahama
6,909,104 B1 6/2005 Koops
6,924,920 B2 8/2005 Zhilkov
6,936,981 B2 8/2005 Gesley
6,943,650 B2 9/2005 Ramprasad et al.
6,944,369 B2 9/2005 Deliwala
6,952,492 B2 10/2005 Tanaka et al.
6,953,291 B2 10/2005 Liu
6,954,515 B2 10/2005 Bjorkholm et al.
6,965,284 B2 11/2005 Maekawa et al.
6,965,625 B2 11/2005 Mross et al.
6,972,439 B1 12/2005 Kim et al.
6,995,406 B2 2/2006 Tojo et al.
7,010,183 B2 3/2006 Estes et al.
7,064,500 B2 6/2006 Victor et al.
7,068,948 B2 6/2006 Wei et al.
7,092,588 B2 8/2006 Kondo
7,092,603 B2 8/2006 Glebov et al.
7,098,615 B2 * 8/2006 Swenson et al. ..... 315/505
7,122,978 B2 10/2006 Nakanishi et al.
7,130,102 B2 10/2006 Rabinowitz
7,177,515 B2 2/2007 Estes et al.
7,194,798 B2 3/2007 Bonhote et al.
7,230,201 B1 6/2007 Miley et al.
7,253,426 B2 8/2007 Gorrell et al.
7,267,459 B2 9/2007 Matheson
7,267,461 B2 9/2007 Kan et al.
7,309,953 B2 12/2007 Tiberi et al.
7,342,441 B2 3/2008 Gorrell et al.
7,362,972 B2 4/2008 Yavor et al.
7,375,631 B2 5/2008 Moskowitz et al.
7,436,177 B2 10/2008 Gorrell et al.
7,442,940 B2 10/2008 Gorrell et al.
7,443,358 B2 10/2008 Gorrell et al.
7,470,920 B2 12/2008 Gorrell et al.
7,473,917 B2 1/2009 Singh
7,586,097 B2 9/2009 Gorrell et al.
7,586,167 B2 9/2009 Gorrell et al.
2001/0002315 A1 5/2001 Schultz et al.
2001/0025925 A1 10/2001 Abe et al.
2002/0009723 A1 1/2002 Hefti
2002/0027481 A1 3/2002 Fiedziuszko
2002/0036121 A1 3/2002 Ball et al.
2002/0036264 A1 3/2002 Nakasuji et al.
2002/0053638 A1 5/2002 Winkler et al.
2002/0068018 A1 6/2002 Pepper et al.
2002/0070671 A1 6/2002 Small
2002/0071457 A1 6/2002 Hogan
2002/0122531 A1 9/2002 Whitham
2002/0135665 A1 9/2002 Gardner
2002/0139961 A1 10/2002 Kinoshita et al.
2002/0158295 A1 10/2002 Armgarth et al.
2002/0191650 A1 12/2002 Madey et al.
2003/0010979 A1 1/2003 Pardo
2003/0012925 A1 1/2003 Gorrell
2003/0016412 A1 1/2003 Eilenberger et al.
2003/0016421 A1 1/2003 Small
2003/0034535 A1 2/2003 Barenburu et al.
2003/0103150 A1 6/2003 Catrysse et al.
2003/0106998 A1 6/2003 Colbert et al.
2003/0155521 A1 8/2003 Feuerbaum
2003/0158474 A1 8/2003 Scherer et al.
2003/0164947 A1 9/2003 Vaupel
2003/0179974 A1 9/2003 Estes et al.
2003/0206708 A1 11/2003 Estes et al.
2003/0214695 A1 11/2003 Abramson et al.
2004/0061053 A1 4/2004 Taniguchi et al.
2004/0080285 A1 4/2004 Victor et al.
2004/0085159 A1 5/2004 Kubena et al.
2004/0092104 A1 5/2004 Gunn, III et al.
2004/0108471 A1 6/2004 Luo et al.
2004/0108473 A1 6/2004 Melnychuk et al.
2004/0108823 A1 * 6/2004 Amaldi et al. ..... 315/505
2004/0136715 A1 7/2004 Kondo
2004/0150991 A1 8/2004 Ouderkirk et al.
2004/0171272 A1 9/2004 Jin et al.
2004/0180244 A1 9/2004 Tour et al.
2004/0184270 A1 9/2004 Halter
2004/0213375 A1 10/2004 Bjorkholm et al.
2004/0217297 A1 11/2004 Moses et al.
2004/0218651 A1 11/2004 Iwasaki et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0045832 A1 3/2005 Kelly et al.
2005/0054151 A1 3/2005 Lowther et al.
2005/0067286 A1 3/2005 Ahn et al.
2005/0082469 A1 4/2005 Carlo
2005/0092929 A1 5/2005 Schneiker
2005/0104684 A1 5/2005 Wojcik
2005/0105690 A1 5/2005 Pau et al.
2005/0145882 A1 7/2005 Taylor et al.
2005/0152635 A1 7/2005 Paddon et al.
2005/0162104 A1 7/2005 Victor et al.
2005/0190637 A1 9/2005 Ichimura et al.
2005/0194258 A1 9/2005 Cohen et al.
2005/0201707 A1 9/2005 Glebov et al.
2005/0201717 A1 9/2005 Matsumura et al.
2005/0212503 A1 9/2005 Deibele
2005/0231138 A1 10/2005 Nakanishi et al.
2005/0249451 A1 11/2005 Baehr-Jones et al.
2005/0285541 A1 12/2005 LeChevalier
2006/0007730 A1 1/2006 Nakamura et al.
2006/0018619 A1 1/2006 Helffrich et al.
2006/0035173 A1 2/2006 Davidson et al.
2006/0045418 A1 3/2006 Cho et al.
2006/0050269 A1 3/2006 Brownell
2006/0060782 A1 3/2006 Khursheed
2006/0062258 A1 3/2006 Brau et al.
2006/0131176 A1 6/2006 Hsu
2006/0131695 A1 6/2006 Kuekes et al.
2006/0159131 A1 7/2006 Liu et al.
2006/0164496 A1 7/2006 Tokutake et al.
2006/0187794 A1 8/2006 Harvey et al.
2006/0208667 A1 9/2006 Lys et al.
2006/0216940 A1 9/2006 Gorrell et al.
2006/0243925 A1 11/2006 Barker et al.
2006/0274922 A1 12/2006 Ragsdale
2007/0003781 A1 1/2007 de Rochemont
2007/0013765 A1 1/2007 Hudson et al.
2007/0075263 A1 4/2007 Gorrell et al.
2007/0075264 A1 4/2007 Gorrell et al.
2007/0085039 A1 4/2007 Gorrell et al.
2007/0086915 A1 4/2007 LeBoeuf et al.
2007/0116420 A1 5/2007 Estes et al.
2007/0146704 A1 6/2007 Schmidt et al.
2007/0152176 A1 7/2007 Gorrell et al.
2007/0154846 A1 7/2007 Gorrell et al.
2007/0194357 A1 8/2007 Oohashi et al.
2007/0200940 A1 8/2007 Gruhlke et al.
2007/0238037 A1 10/2007 Wuister et al.
2007/0252983 A1 11/2007 Tong et al.
2007/0258492 A1 11/2007 Gorrell
2007/0258689 A1 11/2007 Gorrell et al.
2007/0258690 A1 11/2007 Gorrell et al.
2007/0259641 A1 11/2007 Gorrell

| | | | | |
|---|---|---|---|---|
| 2007/0264023 | A1 | 11/2007 | Gorrell et al. | |
| 2007/0264030 | A1 | 11/2007 | Gorrell et al. | |
| 2007/0282030 | A1 | 12/2007 | Anderson et al. | |
| 2007/0284527 | A1 | 12/2007 | Zani et al. | |
| 2008/0069509 | A1 | 3/2008 | Gorrell et al. | |
| 2008/0218102 | A1 * | 9/2008 | Sliski et al. | 315/502 |
| 2008/0302963 | A1 | 12/2008 | Nakasuji et al. | |

FOREIGN PATENT DOCUMENTS

| | | | |
|---|---|---|---|
| JP | 2004-32323 | A | 1/2004 |
| WO | WO 87/01873 | | 3/1987 |
| WO | WO 93/21663 | A1 | 10/1993 |
| WO | WO 00/72413 | | 11/2000 |
| WO | WO 02/25785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2005/098966 | | 10/2005 |
| WO | WO 2006/042239 | A2 | 4/2006 |
| WO | WO 2007/081389 | | 7/2007 |
| WO | WO 2007/081390 | | 7/2007 |
| WO | WO 2007/081391 | | 7/2007 |

OTHER PUBLICATIONS

Search Report and Written Opinion mailed Apr. 3, 2008 in PCT Appln. No. PCT/US2006/027429.
Search Report and Written Opinion mailed Jun. 18, 2008 in PCT Appln. No. PCT/US2006/027430.
Search Report and Written Opinion mailed Jun. 3, 2008 in PCT Appln. No. PCT/US2006/022783.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
U.S. Appl. No. 11/418,082, filed May 5, 2006, Gorrell et al.
J. C. Palais, "Fiber optic communications," Prentice Hall, New Jersey, 1998, pp. 156-158.
Search Report and Written Opinion mailed Dec. 20, 2007 in PCT Appln. No. PCT/US2006/022771.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Mar. 11, 2008 in PCT Appln. No. PCT/US2006/022679.
"An Early History—Invention of the Klystron," http://varianinc.com/cgi-bin/advprint/print.cgi?cid=KLQNPPJJFJ, printed on Dec. 26, 2008.
"An Early History—The Founding of Varian Associates," http://varianinc.com/cgi-bin/advprint/print.cgi?cid=KLQNPPJJFJ, printed on Dec. 26, 2008.
"Chapter 3 E-Ray Tube," http://compepid.tuskegee.edu/syllabi/clinical/small/radiology/chapter..., printed from tuskegee.edu on Dec. 29, 2008.
"Diagnostic imaging modalities—Ionizing vs non-ionizing radiation," http://info.med.yale.edu/intmed/cardio/imaging/techniques/ionizing_v..., printed from Yale University School of Medicine on Dec. 29, 2008.
"Frequently Asked Questions," Luxtera Inc., found at http://www.luxtera.com/technology_faq.htm, printed on Dec. 2, 2005, 4 pages.
"Klystron Amplifier," http://www.radartutorial.eu/08.transmitters/tx12.en.html, printed on Dec. 26, 2008.
"Klystron is a Micowave Generator," http://www2.slac.stanford.edu/vvc/accelerators/klystron.html, printed on Dec. 26, 2008.
"Klystron," http:en.wikipedia.org/wiki/Klystron, printed on Dec. 26, 2008.
"Making E-rays," http://www.fnrfscience.cmu.ac.th/theory/radiation/xray-basics.html, printed on Dec. 29, 2008.
"Microwave Tubes," http://www.tpub.com/neets/book11/45b.htm, printed on Dec. 26, 2008.
"Notice of Allowability" mailed on Jan. 17, 2008 in U.S. Appl. No. 11/418,082, filed May 5, 2006.
"Technology Overview," Luxtera, Inc., found at http://www.luxtera.com/technology.htm, printed on Dec. 2, 2005, 1 page.
"The Reflex Klystron," http://www.fnrfscience.cmu.ac.th/theory/microwave/microwave%2, printed from Fast Netoron Research Facilty on Dec. 26, 2008.
"x-ray tube," http://www.answers.com/topic/x-ray-tube, printed on Dec. 29, 2008.
Corcoran, Elizabeth, "Ride the Light," Forbes Magazine, Apr. 11, 2005, pp. 68-70.
Neo et al., "Smith-Purcell Radiation from Ultraviolet to Infrared Using a Si-field Emitter" Vacuum Electronics Conference, 2007, IVEC '07, IEEE International May 2007.
Saraph, Girish P. et al., "Design of a Single-Stage Depressed Collector for High-Power, Pulsed Gyroklystrom Amplifiers," IEEE Transactions on Electron Devices, vol. 45, No. 4, Apr. 1998, pp. 986-990.
Sartori, Gabriele, "CMOS Photonics Platform," Luxtera, Inc., Nov. 2005, 19 pages.
Search Report and Writen Opinion mailed Jul. 14, 2008 in PCT Appln. No. PCT/US2006/022773.
Search Report and Written Opinion mailed Aug. 19, 2008 in PCT Appln. No. PCT/US2007/008363.
Search Report and Written Opinion mailed Jul. 16, 2008 in PCT Appln. No. PCT/US2006/022766.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Sep. 2, 2008 in PCT Appln. No. PCT/US2006/022769.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.
Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.
Markoff, John, "A Chip That Can Transfer Data Using Laser Light," The New York Times, Sep. 18, 2006.
S.M. Sze, "Semiconductor Devices Physics and Technology", 2nd Edition, Chapters 9 and 12, Copyright 1985, 2002.
Search Report and Written Opinion mailed Feb. 12, 2007 in PCT Appln. No. PCT/US2006/022682.
Search Report and Written Opinion mailed Feb. 20, 2007 in PCT Appln. No. PCT/US2006/022676.
Search Report and Written Opinion mailed Feb. 20, 2007 in PCT Appln. No. PCT/US2006/022772.
Search Report and Written Opinion mailed Feb. 20, 2007 in PCT Appln. No. PCT/US2006/022780.
Search Report and Written Opinion mailed Feb. 21, 2007 in PCT Appln. No. PCT/US2006/022684.
Search Report and Written Opinion mailed Jan. 17, 2007 in PCT Appln. No. PCT/US2006/022777.
Search Report and Written Opinion mailed Jan. 23, 2007 in PCT Appln. No. PCT/US2006/022781.
Search Report and Written Opinion mailed Mar. 7, 2007 in PCT Appln. No. PCT/US2006/022775.
Speller et al., "A Low-Noise MEMS Accelerometer for Unattended Ground Sensor. Applications", Applied MEMS Inc., 12200 Parc Crest, Stafford, TX, USA 77477.

Thurn-Albrecht et al., "Ultrahigh-Density Nanowire Arrays Grown in Self-Assembled Diblock Copolymer Templates", Science 290. 5499, Dec. 15, 2000, pp. 2126-2129.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.
Search Report and Written Opinion mailed Sep. 17, 2007 in PCT Appln. No. PCT/US2006/022689.
International Search Report and Written Opinion mailed Nov. 23, 2007 in International Application No. PCT/US2006/022786.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.
"Array of Nanoklystrons for Frequency Agility or Redundancy," NASA's Jet Propulsion Laboratory, NASA Tech Briefs, NPO-21033. 2001.
"Antenna Arrays." May 18, 2002. www.tpub.com/content/neets/14183/css/14183_159.htm.
Alford, T.L. et al., "Advanced silver-based metallization patterning for ULSI applications," Microelectronic Engineering 55, 2001, pp. 383-388, Elsevier Science B.V.
Amato, Ivan, "An Everyman's Free-Electron Laser?" Science, New Series, Oct. 16, 1992, p. 401, vol. 258 No. 5081, American Association for the Advancement of Science.
Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.
Bakhtyari, A. et al., "Horn Resonator Boosts Miniature Free-Electron Laser Power," Applied Physics Letters, May 12, 2003, pp. 3150-3152, vol. 82, No. 19, American Institute of Physics.
Gallerano, G.P. et al., "Overview of Terahertz Radiation Sources," Proceedings of the 2004 FEL Conference, pp. 216-221.
Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.
Gover, A. et al., "Angular Radiation Pattern of Smith-Purcell Radiation," Journal of the Optical Society of America, Oct. 1984, pp. 723-728, vol. 1 No. 5, Optical Society of America.
Grishin, Yu. A. et al., "Pulsed Orotron—A New Microwave Source for Submillimeter Pulse High -Field Electron Paramagnetic Resonance Spectroscopy," Review of Scientific Instruments, Sep. 2004, pp. 2926-2936, vol. 75 No. 9, American Institute of Physics.
Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.
Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.
Ives, Lawrence et al., "Development of Backward Wave Oscillators for Terahertz Applications," Terahertz for Military and Security Applications, Proceedings of SPIE vol. 5070 (2003), pp. 71-82.
Ives, R. Lawrence, "IVEC Summary, Session 2, Sources I" 2002.
Jonietz, Erika, "Nano Antenna Gold nanospheres show path to all-optical computing," Technology Review, Dec. 2005/Jan. 2006, p. 32.
Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA Nov. 1995 pp. 117-121.
Bhattacharjee, Sudeep et al., "Folded Waveguide Traveling-Wave Tube Sources for Terahertz Radiation." IEEE Transactions on Plasma Science, vol. 32. No. 3, Jun. 2004, pp. 1002-1014.
Brau, C.A. et al., "Gain and Coherent Radiation from a Smith-Purcell Free Electron Laser," Proceedings of the 2004 FEL Conference, pp. 278-281.
Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.
Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.
Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.
Chuang, S.L. et al., "Smith-Purcell Radiation from a Charge Moving Above a Penetrable Grating," IEEE MTT-S Digest, 1983, pp. 405-406, IEEE.
Far-IR, Sub-MM & MM Detector Technology Workshop list of manuscripts, session 6 2002.
Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.
Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.
Joo, Youngcheol et al., "Fabrication of Monolithic Microchannels for IC Chip Cooling," 1995, Mechanical, Aerospace and Nuclear Engineering Department, University of California at Los Angeles.
Jung, K.B. et al., "Patterning of Cu, Co, Fe, and Ag for magnetic nanostructures," J. Vac. Sci. Technol. A 15(3), May/Jun. 1997, pp. 1780-1784.
Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.
Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.
Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.
Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.
Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.
McDaniel, James C. et al., "Smith-Purcell Radiation in the High Conductivity and Plasma Frequency Limits," Applied Optics, Nov. 15, 1989, pp. 4924-4929, vol. 28 No. 22, Optical Society of America.

Meyer, Stephan, "Far IR, Sub-MM & MM Detector Technology Workshop Summary," Oct. 2002. (may date the Manohara documents).
Mokhoff, Nicolas, "Optical-speed light detector promises fast space talk," EETimes Online, Mar. 20, 2006, from website: www.eetimes.com/showArticle.jhtml?articleID=183701047.
Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.
Nguyen, Phucanh et al., "Reactive ion etch of patterned and blanket silver thin films in CI2/O2 and O2 glow discharges," J. Vac. Sci, Technol. B. 17 (5), Sep./Oct. 1999, American Vacuum Society, pp. 2204-2209.
Phototonics Research, "Surface-Plasmon-Enhanced Random Laser Demonstrated," Phototonics Spectra, Feb. 2005, pp. 112-113.
Potylitsin, A.P., "Resonant Diffraction Radiation and Smith-Purcell Effect," (Abstract), arXiv: physics/9803043 v2 Apr. 13, 1998.
Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1989, pp. 3267-3269, vol. 65 No. 8, American Institute of Physics.
Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7 No. 5, Optical Society of America.
Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7 No. 3, Optical Society of America.
Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.
Mar. 24, 2006 PTO Office Action in U.S. Appl. No. 10/917,511.
Mar. 25, 2008 PTO Office Action in U.S. Appl. No. 11/411,131.
Apr. 8, 2008 PTO Office Action in U.S. Appl. No. 11/325,571.
Apr. 17, 2008 Response to PTO Office Action of Dec. 20, 2007 in U.S. Appl. No. 11/418,087.
Apr. 19, 2007 Response to PTO Office Action of Jan. 17, 2007 in U.S. Appl. No. 11/418,082.
May 10, 2005 PTO Office Action in U.S. Appl. No. 10/917,511.
May 21, 2007 PTO Office Action in U.S. Appl. No. 11/418,087.
May 26, 2006 Response to PTO Office Action of Mar. 24, 2006 in U.S. Appl. No. 10/917,511.
Jun. 16, 2008 Response to PTO Office Action of Dec. 14, 2007 in U.S. Appl. No. 11/418,264.
Jun. 20, 2008 Response to PTO Office Action of Mar. 25, 2008 in U.S. Appl. No. 11/411,131.
Aug. 14, 2006 PTO Office Action in U.S. Appl. No. 10/917,511.
Sep. 1, 2006 Response to PTO Office Action of Aug. 14, 2006 in U.S. Appl. No. 10/917,511.
Sep. 12, 2005 Response to PTO Office Action of May 10, 2005 in U.S. Appl. No. 10/917,511.
Sep. 14, 2007 PTO Office Action in U.S. Appl. No. 11/411,131.
Oct. 19, 2007 Response to PTO Office Action of May 21, 2007 in U.S. Appl. No. 11/418,087.
Dec. 4, 2006 PTO Office Action in U.S. Appl. No. 11/418,087.
Dec. 14, 2007 PTO Office Action in U.S. Appl. No. 11/418,264.
Dec. 14, 2007 Response to PTO Office Action of Sep. 14, 2007 in U.S. Appl. No. 11/411,131.
Dec. 20, 2007 PTO Office Action in U.S. Appl. No. 11/418,087.
European Search Report mailed Mar. 3, 2009 in European Application No. 06852028.7.
U.S. Appl. No. 11/203,407—Nov. 13, 2008 PTO Office Action.
U.S. Appl. No. 11/238,991—Dec. 6, 2006 PTO Office Action.
U.S. Appl. No. 11/238,991—Jun. 6, 2007 Response to PTO Office Action of Dec. 6, 2006.
U.S. Appl. No. 11/238,991—Sep. 10, 2007 PTO Office Action.
U.S. Appl. No. 11/238,991—Mar. 6, 2008 Response to PTO Office Action of Sep. 10, 2007.
U.S. Appl. No. 11/238,991—Jun. 27, 2008 PTO Office Action.
U.S. Appl. No. 11/238,991—Dec. 29, 2008 Response to PTO Office Action of Jun. 27, 2008.
U.S. Appl. No. 11/238,991—Mar. 24, 2009 PTO Office Action.
U.S. Appl. No. 11/243,477—Apr. 25, 2008 PTO Office Action.
U.S. Appl. No. 11/243,477—Oct. 24, 2008 Response to PTO Office Action of Apr. 25, 2008.
U.S. Appl. No. 11/243,477—Jan. 7, 2009 PTO Office Action.
U.S. Appl. No. 11/325,448—Jun. 16, 2008 PTO Office Action.
U.S. Appl. No. 11/325,448—Dec. 16, 2008 Response to PTO Office Action of Jun. 16, 2008.
U.S. Appl. No. 11/325,534—Jun. 11, 2008 PTO Office Action.
U.S. Appl. No. 11/325,534—Oct. 15, 2008 Response to PTO Office Action of Jun. 11, 2008.
U.S. Appl. No. 11/353,208—Jan. 15, 2008 PTO Office Action.
U.S. Appl. No. 11/353,208—Mar. 17, 2008 PTO Office Action.
U.S. Appl. No. 11/353,208—Sep. 15, 2008 Response to PTO Office Action of Mar. 17, 2008.
U.S. Appl. No. 11/353,208—Dec. 24, 2008 PTO Office Action.
U.S. Appl. No. 11/353,208—Dec. 30, 2008 Response to PTO Office Action of Dec. 24, 2008.
U.S. Appl. No. 11/400,280—Oct. 16, 2008 PTO Office Action.
U.S. Appl. No. 11/400,280—Oct. 24, 2008 Response to PTO Office Action of Oct. 16, 2008.
U.S. Appl. No. 11/410,905—Sep. 26, 2008 PTO Office Action.
U.S. Appl. No. 11/410,905—Mar. 26, 2009 Response to PTO Office Action of Sep. 26, 2008.
U.S. Appl. No. 11/410,924—Mar. 6, 2009 PTO Office Action.
U.S. Appl. No. 11/411,120—Mar. 19, 2009 PTO Office Action.
U.S. Appl. No. 11/411,129—Jan. 16, 2009 Office Action.
U.S. Appl. No. 11/411,130—May 1, 2008 PTO Office Action.
U.S. Appl. No. 11/411,130—Oct. 29, 2008 Response to PTO Office Action of May 1, 2008.
U.S. Appl. No. 11/417,129—Jul. 11, 2007 PTO Office Action.
U.S. Appl. No. 11/417,129—Dec. 17, 2007 Response to PTO Office Action of Jul. 11, 2007.
U.S. Appl. No. 11/417,129—Dec. 20, 2007 Response to PTO Office Action of Jul. 11, 2007.
U.S. Appl. No. 11/417,129—Apr. 17, 2008 PTO Office Action.
U.S. Appl. No. 11/417,129—Jun. 19, 2008 Response to PTO Office Action of Apr. 17, 2008.
U.S. Appl. No. 11/418,079—Apr. 11, 2008 PTO Office Action.
U.S. Appl. No. 11/418,079—Oct. 7, 2008 Response to PTO Office Action of Apr. 11, 2008.
U.S. Appl. No. 11/418,079—Feb. 12, 2009 PTO Office Action.
U.S. Appl. No. 11/418,080—Mar. 18, 2009 PTO Office Action.
U.S. Appl. No. 11/418,082—Jan. 17, 2007 PTO Office Action.

U.S. Appl. No. 11/418,083—Jun. 20, 2008 PTO Office Action.
U.S. Appl. No. 11/418,083—Dec. 18, 2008 Response to PTO Office Action of Jun. 20, 2008.
U.S. Appl. No. 11/418,084—Nov. 5, 2007 PTO Office Action.
U.S. Appl. No. 11/418,084—May 5, 2008 Response to PTO Office Action of Nov. 5, 2007.
U.S. Appl. No. 11/418,084—Aug. 19, 2008 PTO Office Action.
U.S. Appl. No. 11/418,084—Feb. 19, 2009 Response to PTO Office Action of Aug. 19, 2008.
U.S. Appl. No. 11/418,085—Aug. 10, 2007 PTO Office Action.
U.S. Appl. No. 11/418,085—Nov. 13, 2007 Response to PTO Office Action of Aug. 10, 2007.
U.S. Appl. No. 11/418,085—Feb. 12, 2008 PTO Office Action.
U.S. Appl. No. 11/418,085—Aug. 12, 2008 Response to PTO Office Action of Feb. 12, 2008.
U.S. Appl. No. 11/418,085—Sep. 16, 2008 PTO Office Action.
U.S. Appl. No. 11/418,085—Mar. 6, 2009 Response to PTO Office Action of Sep. 16, 2008.
U.S. Appl. No. 11/418,087—Dec. 29, 2006 Response to PTO Office Action of Dec. 4, 2006.
U.S. Appl. No. 11/418,087—Feb. 15, 2007 PTO Office Action.
U.S. Appl. No. 11/418,087—Mar. 6, 2007 Response to PTO Office Action of Feb. 15, 2007.
U.S. Appl. No. 11/418,088—Jun. 9, 2008 PTO Office Action.
U.S. Appl. No. 11/418,088—Dec. 8, 2008 Response to PTO Office Action of Jun. 9, 2008.
U.S. Appl. No. 11/418,089—Mar. 21, 2008 PTO Office Action.
U.S. Appl. No. 11/418,089—Jun. 23, 2008 Response to PTO Office Action of Mar. 21, 2008.
U.S. Appl. No. 11/418,089—Sep. 30, 2008 PTO Office Action.
U.S. Appl. No. 11/418,089—Mar. 30, 2009 Response to PTO Office Action of Sep. 30, 2008.
U.S. Appl. No. 11/418,091—Jul. 30, 2007 PTO Office Action.
U.S. Appl. No. 11/418,091—Nov. 27, 2007 Response to PTO Office Action of Jul. 30, 2007.
U.S. Appl. No. 11/418,091—Feb. 26, 2008 PTO Office Action.
U.S. Appl. No. 11/418,097—Jun. 2, 2008 PTO Office Action.
U.S. Appl. No. 11/418,097—Dec. 2, 2008 Response to PTO Office Action of Jun. 22, 2008.
U.S. Appl. No. 11/418,097—Feb. 18, 2009 PTO Office Action.
U.S. Appl. No. 11/418,099—Jun. 23, 2008 PTO Office Action.
U.S. Appl. No. 11/418,099—Dec. 23, 2008 Response to PTO Office Action of Jun. 23, 2008.
U.S. Appl. No. 11/418,100—Jan. 12, 2009 PTO Office Action.
U.S. Appl. No. 11/418,123—Apr. 25, 2008 PTO Office Action.
U.S. Appl. No. 11/418,123—Oct. 27, 2008 Response to PTO Office Action of Apr. 25, 2008.
U.S. Appl. No. 11/418,123—Jan. 26, 2009 PTO Office Action.
U.S. Appl. No. 11/418,124—Oct. 1, 2008 PTO Office Action.
U.S. Appl. No. 11/418,124—Feb. 2, 2009 Response to PTO Office Action of Oct. 1, 2008.
U.S. Appl. No. 11/418,124—Mar. 13, 2009 PTO Office Action.
U.S. Appl. No. 11/418,126—Oct. 12, 2006 PTO Office Action.
U.S. Appl. No. 11/418,126—Feb. 12, 2007 Response to PTO Office Action of Oct. 12, 2006 (REDACTED).
U.S. Appl. No. 11/418,126—Jun. 6, 2007 PTO Office Action.
U.S. Appl. No. 11/418,126—Aug. 6, 2007 Response to PTO Office Action of Jun. 6, 2007.
U.S. Appl. No. 11/418,126—Nov. 2, 2007 PTO Office Action.
U.S. Appl. No. 11/418,126—Feb. 22, 2008 Response to PTO Office Action of Nov. 2, 2007.
U.S. Appl. No. 11/418,126—Jun. 10, 2008 PTO Office Action.
U.S. Appl. No. 11/418,127—Apr. 2, 2009 Office Action.
U.S. Appl. No. 11/418,128—Dec. 16, 2008 PTO Office Action.
U.S. Appl. No. 11/418,128—Dec. 31, 2008 Response to PTO Office Action of Dec. 16, 2008.
U.S. Appl. No. 11/418,128—Feb. 17, 2009 PTO Office Action.
U.S. Appl. No. 11/418,129—Dec. 16, 2008 Office Action.
U.S. Appl. No. 11/418,129—Dec. 31, 2008 Response to PTO Office Action of Dec. 16, 2008.
U.S. Appl. No. 11/418,244—Jul. 1, 2008 PTO Office Action.
U.S. Appl. No. 11/418,244—Nov. 25, 2008 Response to PTO Office Action of Jul. 1, 2008.
U.S. Appl. No. 11/418,315—Mar. 31, 2008 PTO Office Action.
U.S. Appl. No. 11/418,318—Mar. 31, 2009 PTO Office Action.
U.S. Appl. No. 11/441,219—Jan. 7, 2009 PTO Office Action.
U.S. Appl. No. 11/522,929—Oct. 22, 2007 PTO Office Action.
U.S. Appl. No. 11/522,929—Feb. 21, 2008 Response to PTO Office Action of Oct. 22, 2007.
U.S. Appl. No. 11/641,678—Jul. 22, 2008 PTO Office Action.
U.S. Appl. No. 11/641,678—Jan. 22, 2009 Response to Office Action of Jul. 22, 2008.
U.S. Appl. No. 11/711,000—Mar. 6, 2009 PTO Office Action.
U.S. Appl. No. 11/716,552—Feb. 12, 2009 Response to PTO Office Action of Feb. 9, 2009.
U.S. Appl. No. 11/716,552—Jul. 3, 2009 PTO Office Action.
Brau et al., "Tribute to John E Walsh", Nuclear Instruments and Methods in Physics Research Section A. Accelerators, Spectrometers, Detectors and Associated Equipment, vol. 475, Issues 1-3, Dec. 21, 2001, pp. xiii-xiv.
Kapp, et al., "Modification of a scanning electron microscope to produce Smith-Purcell radiation", Rev. Sci. Instrum. 75, 4732 (2004).
Scherer et al. "Photonic Crystals for Confining, Guiding, and Emitting Light", IEEE Transactions on Nanotechnology, vol. 1, No. 1, Mar. 2002, pp. 4-11.
U.S. Appl. No. 11/203,407—Jul. 17, 2009 PTO Office Action.
U.S. Appl. No. 11/418,097—Sep. 16, 2009 PTO Office Action.
U.S. Appl. No. 11/418,123—Aug. 11, 2009 PTO Office Action.
U.S. Appl. No. 11/418,365—Jul. 23, 2009 PTO Office Action.
U.S. Appl. No. 11/441,240—Aug. 31, 2009 PTO Office Action.
Urata et al., "Superradiant Smith-Purcell Emission", Phys. Rev. Lett. 80, 516-519 (1998).
"Notice of Allowability" mailed on Jul. 2, 2009 in U.S. Appl. No. 11/410,905, filed Apr. 26, 2006.
"Notice of Allowability" mailed on Jun. 30, 2009 in U.S. Appl. No. 11/418,084, filed May 5, 2006.
B. B Loechel et al., "Fabrication of Magnetic Microstructures by Using Thick Layer Resists", Microelectronics Eng., vol. 21, pp. 463-466 (1993).
Magellan 8500 Scanner Product Reference Guide, PSC Inc., 2004, pp. 6-27—F18.
Magellan 9500 with SmartSentry Quick Reference Guide, PSC Inc., 2004.
Response to Non-Final Office Action submitted May 13, 2009 in U.S. Appl. No. 11/203,407.
U.S. Appl. No. 11/238,991, filed May 11, 2009 PTO Office Action.
U.S. Appl. No. 11/350,812—Apr. 17, 2009 Office Action.
U.S. Appl. No. 11/411,130—Jun. 23, 2009 PTO Office Action.
U.S. Appl. No. 11/418,089—Jul. 15, 2009 PTO Office Action.
U.S. Appl. No. 11/418,096—Jun. 23, 2009 PTO Office Action.
U.S. Appl. No. 11/433,486—Jun. 19, 2009 PTO Office Action.

* cited by examiner

DIAMOND FIELD EMISSION TIP AND A METHOD OF FORMATION

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

RELATED APPLICATIONS

This application is related to and claims priority from U.S. patent application Ser. No. 11/238,991, titled "Ultra-Small Resonating Charged Particle Beam Modulator," and filed Sep. 30, 2005, the entire contents of which are incorporated herein by reference. This application is related to U.S. patent application Ser. No. 10/917,511, filed on Aug. 13, 2004, entitled "Patterning Thin Metal Film by Dry Reactive Ion Etching"; U.S. application Ser. No. 11/203,407, entitled "Method Of Patterning Ultra-Small Structures," filed on Aug. 15, 2005; U.S. patent application Ser. No. 11/243,476, filed on Oct. 5, 2005, entitled "Structures and Methods For Coupling Energy From An Electromagnetic Wave"; and, U.S. application Ser. No. 11/243,477, titled "Electron Beam Induced Resonance," filed on Oct. 5, 2005, all of which are commonly owned with the present application at the time of filing, and the entire contents of each of which are incorporated herein by reference.

FIELD OF INVENTION

This disclosure relates to an improved charged particle field emission tip.

INTRODUCTION AND BACKGROUND

Electromagnetic Radiation & Waves

Electromagnetic radiation is produced by the motion of electrically charged particles. Oscillating electrons produce electromagnetic radiation commensurate in frequency with the frequency of the oscillations. Electromagnetic radiation is essentially energy transmitted through space or through a material medium in the form of electromagnetic waves. The term can also refer to the emission and propagation of such energy. Whenever an electric charge oscillates or is accelerated, a disturbance characterized by the existence of electric and magnetic fields propagates outward from it. This disturbance is called an electromagnetic wave. Electromagnetic radiation falls into categories of wave types depending upon their frequency, and the frequency range of such waves is tremendous, as is shown by the electromagnetic spectrum in the following chart (which categorizes waves into types depending upon their frequency):

| Type | Approx. Frequency |
|---|---|
| Radio | Less than 3 Gigahertz |
| Microwave | 3 Gigahertz-300 Gigahertz |
| Infrared | 300 Gigahertz-400 Terahertz |
| Visible | 400 Terahertz-750 Terahertz |

-continued

| Type | Approx. Frequency |
|---|---|
| UV | 750 Terahertz-30 Petahertz |
| X-ray | 30 Petahertz-30 Exahertz |
| Gamma-ray | Greater than 30 Exahertz |

The ability to generate (or detect) electromagnetic radiation of a particular type (e.g., radio, microwave, etc.) depends upon the ability to create a structure suitable for electron oscillation or excitation at the frequency desired. Electromagnetic radiation at radio frequencies, for example, is relatively easy to generate using relatively large or even somewhat small structures.

Electromagnetic Wave Generation

There are many traditional ways to produce high-frequency radiation in ranges at and above the visible spectrum, for example, up to high hundreds of Terahertz. As frequencies increase, however, the kinds of structures needed to create the electromagnetic radiation at a desired frequency become generally smaller and harder to manufacture. We have discovered ultra-small-scale devices that obtain multiple different frequencies of radiation from the same operative layer and that these ultra small devices can be activated by the flow of beams of charged particles.

ADVANTAGES & BENEFITS

Myriad benefits and advantages can be obtained by a ultra-small resonant structure that emits varying electromagnetic radiation at higher radiation frequencies such as infrared, visible, UV and X-ray. For example, if the varying electromagnetic radiation is in a visible light frequency, the micro resonant structure can be used for visible light applications that currently employ prior art semiconductor light emitters (such as LCDs, LEDs, and the like that employ electroluminescence or other light-emitting principals). If small enough, such micro-resonance structures can rival semiconductor devices in size, and provide more intense, variable, and efficient light sources. Such micro resonant structures can also be used in place of (or in some cases, in addition to) any application employing non-semiconductor illuminators (such as incandescent, fluorescent, or other light sources).

The use of radiation per se in each of the above applications is not new. But, obtaining that radiation from particular kinds of increasingly small ultra-small resonant structures revolutionizes the way electromagnetic radiation is used in and can be used in electronic and other devices.

GLOSSARY

As used throughout this document:

The phrase "ultra-small resonant structure" shall mean any structure of any material, type or microscopic size that by its characteristics causes electrons to resonate at a frequency in excess of the microwave frequency.

The term "ultra-small" within the phrase "ultra-small resonant structure" shall mean microscopic structural dimensions and shall include so-called "micro" structures, "nano" structures, or any other very small structures that will produce resonance at frequencies in excess of microwave frequencies.

DESCRIPTION OF PRESENTLY PREFERRED EXEMPLARY EMBODIMENTS OF THE INVENTION

Brief Description of Figures

The invention is better understood by reading the following detailed description with reference to the accompanying drawings in which.

DESCRIPTION

Figure 8:
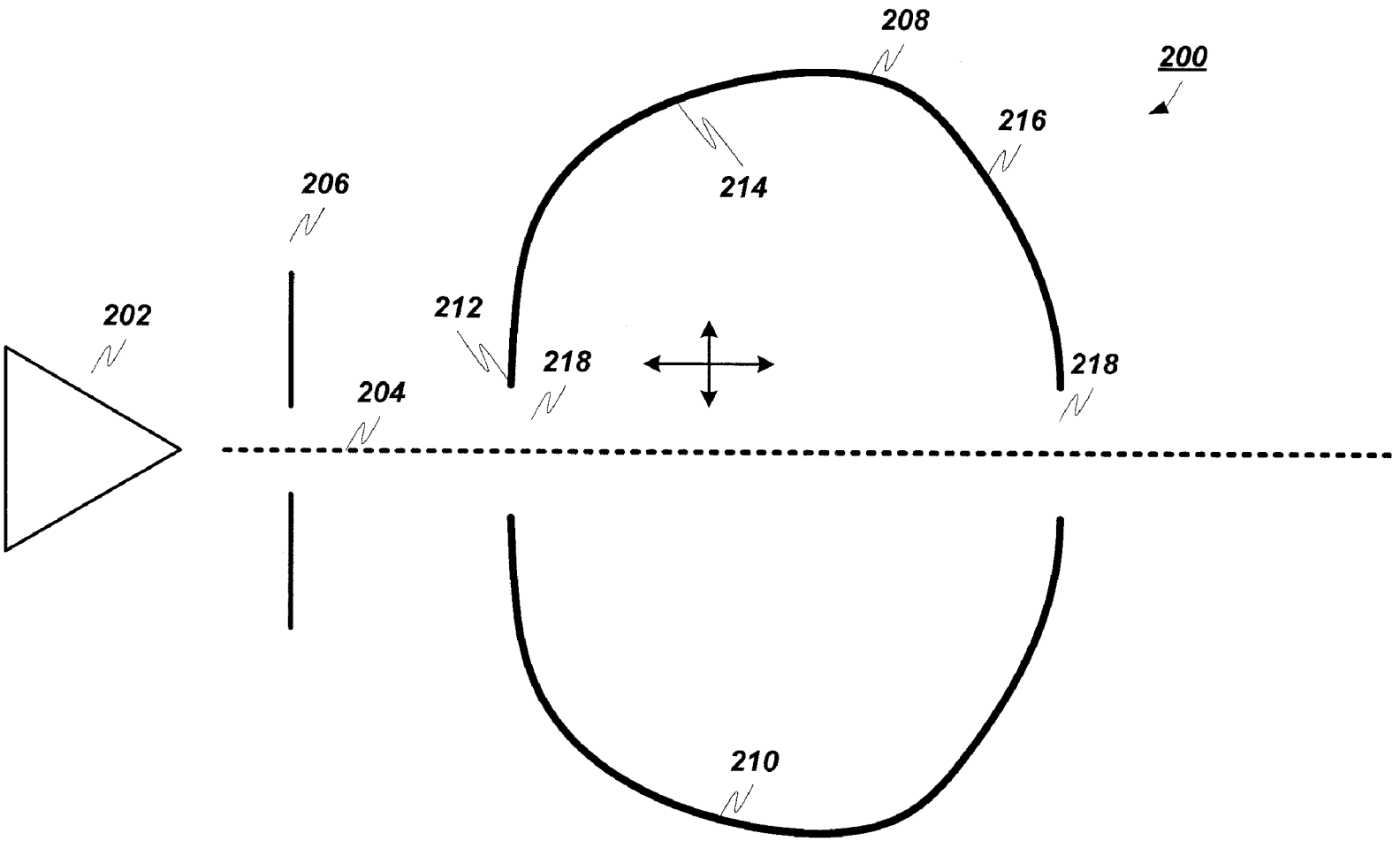
FIG. 8 is a schematic of a charged particle modulator that velocity modulates a beam of charged particles according to embodiments of the present invention.

FIG. 8 depicts a charged particle modulator 200 that velocity modulates a beam of charged particles according to embodiments of the present invention. As shown in FIG. 8, a source of charged particles 202 is shown producing a beam 204 consisting of one or more charged particles. The charged particles can be electrons, protons or ions and can be produced by any source of charged particles including cathodes, tungsten filaments, planar vacuum triodes, ion guns, electron-impact ionizers, laser ionizers, chemical ionizers, thermal ionizers, or ion impact ionizers. The artisan will recognize that many well-known means and methods exist to provide a suitable source of charged particles beyond the means and methods listed.

Beam 204 accelerates as it passes through bias structure 206. The source of charged particles 202 and accretion bias structure 206 are connected across a voltage. Beam 204 then traverses excited ultra-small resonant structures 208 and 210.

An example of an accretion bias structure is an anode, but the artisan will recognize that other means exist for creating an accretion bias structure for a beam of charged particles.

Ultra-small resonant structures 208 and 210 represent a simple form of ultra-small resonant structure fabrication in a planar device structure. Other more complex structures are also envisioned but for purposes of illustration of the principles involved the simple structure of FIG. 8 is described. There is no requirement that ultra-small resonant structures 208 and 210 have a simple or set shape or form. Ultra-small resonant structures 208 and 210 encompass a semi-circular shaped cavity having wall 212 with inside surface 214, outside surface 216 and opening 218. The artisan will recognize that there is no requirement that the cavity have a semi-circular shape but that the shape can be any other type of suitable arrangement.

Ultra-small resonant structures 208 and 210 may have identical shapes and symmetry, but there is no requirement that they be identical or symmetrical in shape or size. There is no requirement that ultra-small resonant structures 208 and 210 be positioned with any symmetry relating to the other. An exemplary embodiment can include two ultra-small resonant structures; however there is no requirement that there be more than one ultra-small resonant structure nor less than any number of ultra-small resonant structures. The number, size and symmetry are design choices once the inventions are understood.

In one exemplary embodiment, wall 212 is thin with an inside surface 214 and outside surface 216. There is, however, no requirement that the wall 212 have some minimal thickness. In alternative embodiments, wall 212 can be thick or thin. Wall 212 can also be single sided or have multiple sides.

In some exemplary embodiments, ultra-small resonant structure 208 encompasses a cavity circumscribing a vacuum environment. There is, however, no requirement that ultra-small resonant structure 208 encompass a cavity circumscribing a vacuum environment. Ultra-small resonant structure 208 can confine a cavity accommodating other environments, including dielectric environments.

In some exemplary embodiments, a current is excited within ultra-small resonant structures 208 and 210. When ultra-small resonant structure 208 becomes excited, a current oscillates around the surface or through the bulk of the ultra-small structure. If wall 212 is sufficiently thin, then the charge of the current will oscillate on both inside surface 214 and outside surface 216. The induced oscillating current engenders a varying electric field across the opening 218.

In some exemplary embodiments, ultra-small resonant structures 208 and 210 are positioned such that some component of the varying electric field induced across opening 218 exists parallel to the propagation direction of beam 204. The varying electric field across opening 218 modulates beam 204. The most effective modulation or energy transfer generally occurs when the charged electrons of beam 204 traverse the gap in the cavity in less time then one cycle of the oscillation of the ultra-small resonant structure.

In some exemplary embodiments, the varying electric field generated at opening 218 of ultra-small resonant structures 208 and 210 are parallel to beam 204. The varying electric field modulates the axial motion of beam 204 as beam 204 passes by ultra-small resonant structures 208 and 210. Beam 204 becomes a space-charge wave or a charge modulated beam at some distance from the resonant structure.

Ultra-small resonant structures can be built in many different shapes. The shape of the ultra-small resonant structure affects its effective inductance and capacitance. (Although traditional inductance an capacitance can be undefined at some of the frequencies anticipated, effective values can be measured or calculated.) The effective inductance and capacitance of the structure primarily determine the resonant frequency.

Ultra-small resonant structures 208 and 210 can be constructed with many types of materials. The resistivity of the material used to construct the ultra-small resonant structure may affect the quality factor of the ultra-small resonant structure. Examples of suitable fabrication materials include silver, high conductivity metals, and superconducting materials. The artisan will recognize that there are many suitable materials from which ultra-small resonant structure 208 may be constructed, including dielectric and semi-conducting materials.

An exemplary embodiment of a charged particle beam modulating ultra-small resonant structure is a planar structure, but there is no requirement that the modulator be fabricated as a planar structure. The structure could be non-planar.

Example methods of producing such structures from, for example, a thin metal are described in commonly-owned U.S. patent application Ser. No. 10/917,511 ("Patterning Thin Metal Film by Dry Reactive Ion Etching"). In that application, etching techniques are described that can produce the cavity structure. There, fabrication techniques are described that result in thin metal surfaces suitable for the ultra-small resonant structures 208 and 210.

Other example methods of producing ultra-small resonant structures are described in commonly-owned U.S. application Ser. No. 11/203,407, filed on Aug. 15, 2005 and entitled "Method of Patterning Ultra-Small Structures." Applications of the fabrication techniques described therein result in microscopic cavities and other structures suitable for high-frequency resonance (above microwave frequencies) including frequencies in and above the range of visible light.

Figure 9:
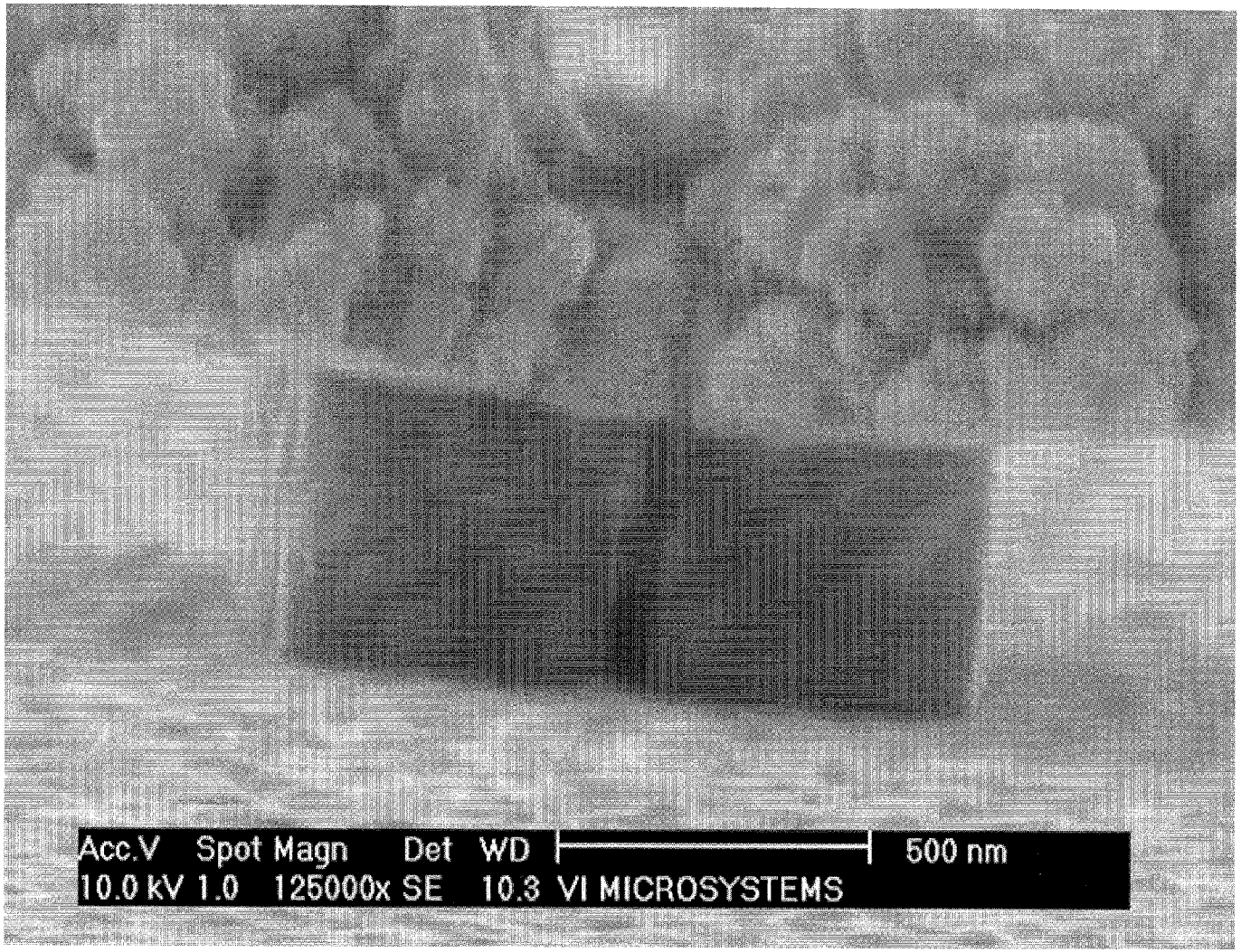
FIG. 9 is an electron microscope photograph illustrating an example ultra-small resonant structure according to embodiments of the present invention.
Figure 10:
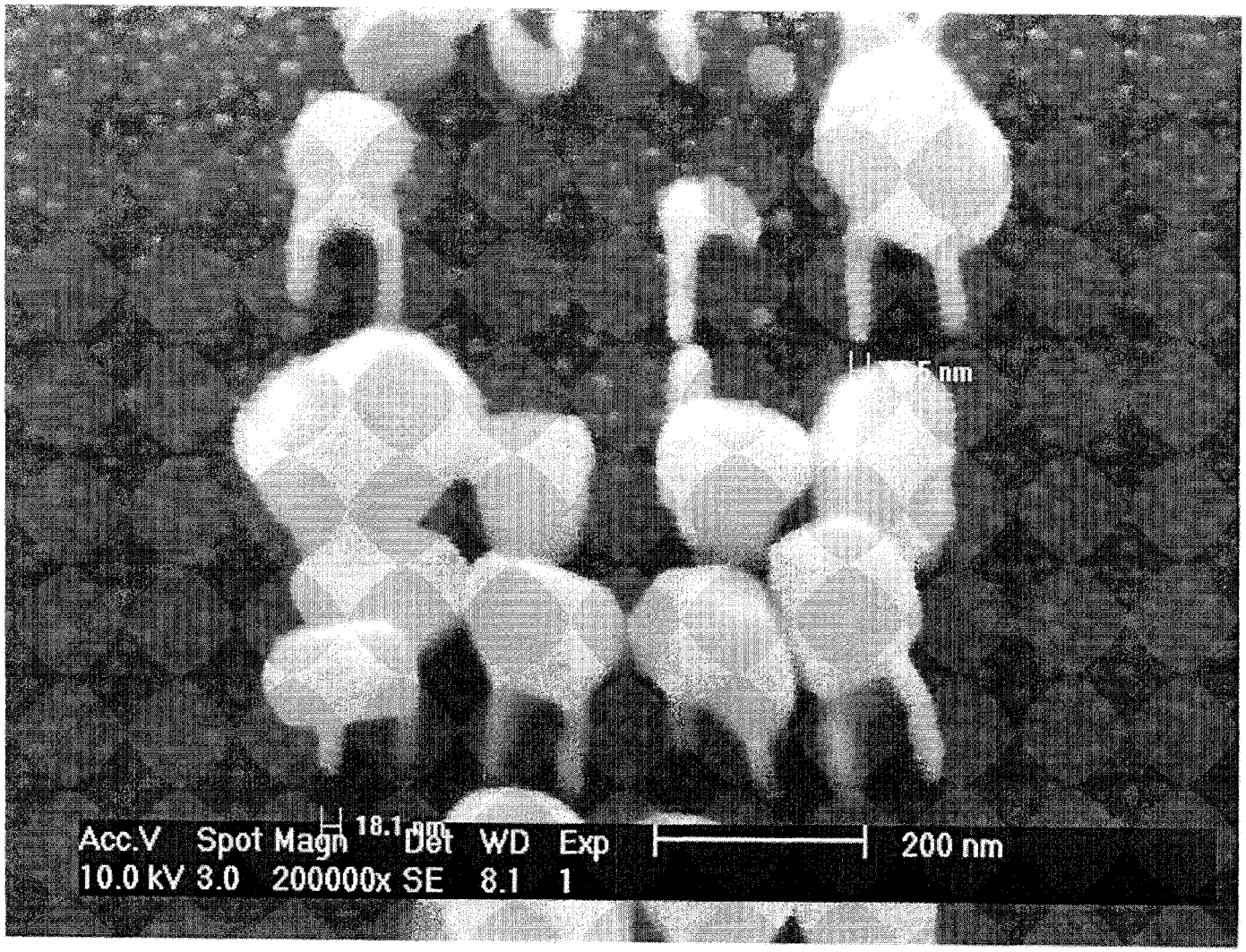
FIG. 10 is an electron microscope photograph illustrating the very small and very vertical walls for the resonant cavity structures according to embodiments of the present invention.

Such techniques can be used to produce, for example, the klystron ultra-small resonant structure shown in FIG. 9. In FIG. 9, the ultra-small resonant klystron is shown as a very small device with smooth and vertical exterior walls. Such smooth vertical walls can also create the internal resonant cavities (examples shown in FIG. 10) within the klystron. The slot in the front of the photo illustrates an entry point for a charged particle beam such as an electron beam. Example cavity structures are shown in FIG. 10, and can be created from the fabrication techniques described in the above-mentioned patent applications. The microscopic size of the resulting cavities is illustrated by the thickness of the cavity walls shown in FIG. 10. In the top right corner, for example, a cavity wall of 16.5 nm is shown with very smooth surfaces and very vertical structure. Such cavity structures can provide electron beam modulation suitable for higher-frequency (above microwave) applications in extremely small structural profiles.

Figure 11:
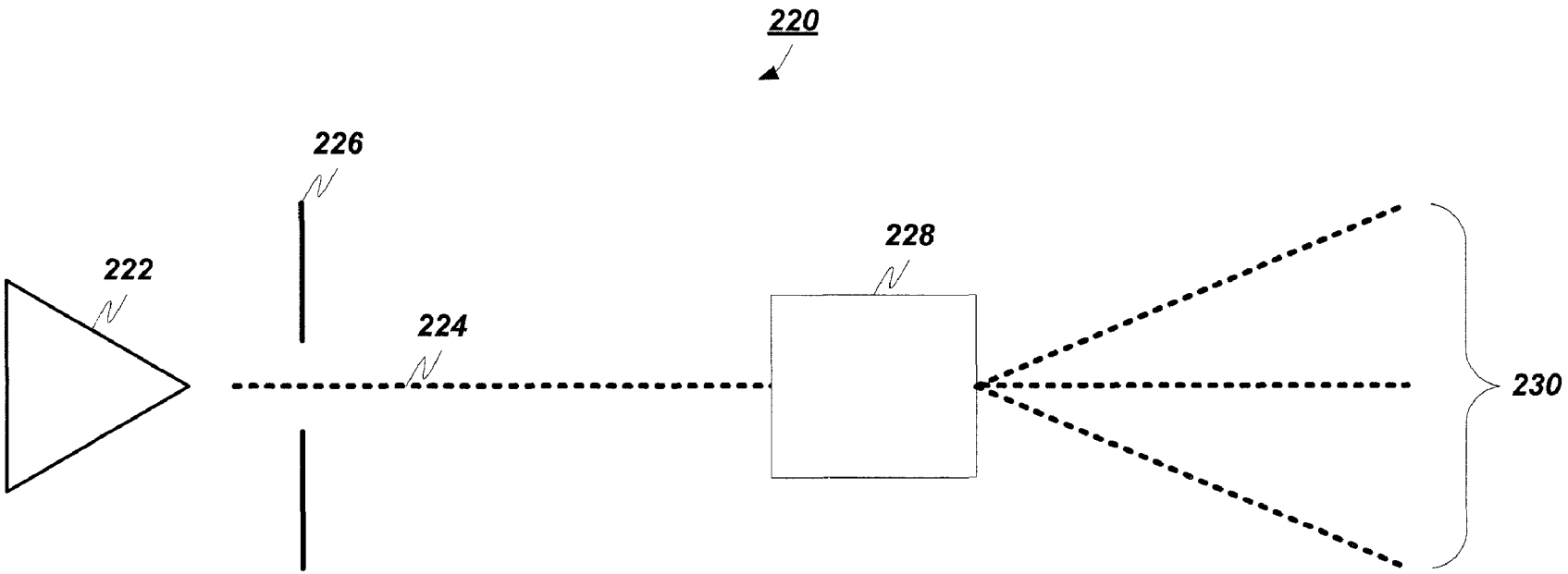
FIG. 11 shows a schematic of a charged particle modulator that angularly modulates a beam of charged particles according to embodiments of the present invention.

FIGS. 10 and 11 are provided by way of illustration and example only. The present invention is not limited to the exact structures, kinds of structures, or sizes of structures shown. Nor is the present invention limited to the exact fabrication techniques shown in the above-mentioned patent applications. A lift-off technique, for example, may be an alternative to the etching technique described in the above-mentioned patent application. The particular technique employed to obtain the ultra-small resonant structure is not restrictive. Rather, we envision ultra-small resonant structures of all types and microscopic sizes for use in the production of electromagnetic radiation and do not presently envision limiting our inventions otherwise.

FIG. 11 shows another exemplary embodiment of a charged particle beam modulator 220 according to embodiments of the present invention. In these embodiments, the source of charged particles 222 produces beam 224, consisting of one or more charged particles, which passes through bias structure 226.

Beam 224 passes by excited ultra-small resonant structure 228 positioned along the path of beam 224 such that some component of the varying electric field induced by the excitation of excited ultra-small resonant structure 228 is perpendicular to the propagation direction of beam 224.

The angular trajectory of beam 224 is modulated as it passes by ultra-small resonant structure 228. As a result, the angular trajectory of beam 224 at some distance beyond ultra-small resonant structure 228 oscillates over a range of values, represented by the array of multiple charged particle beams (denoted 230).

Figure 12A:
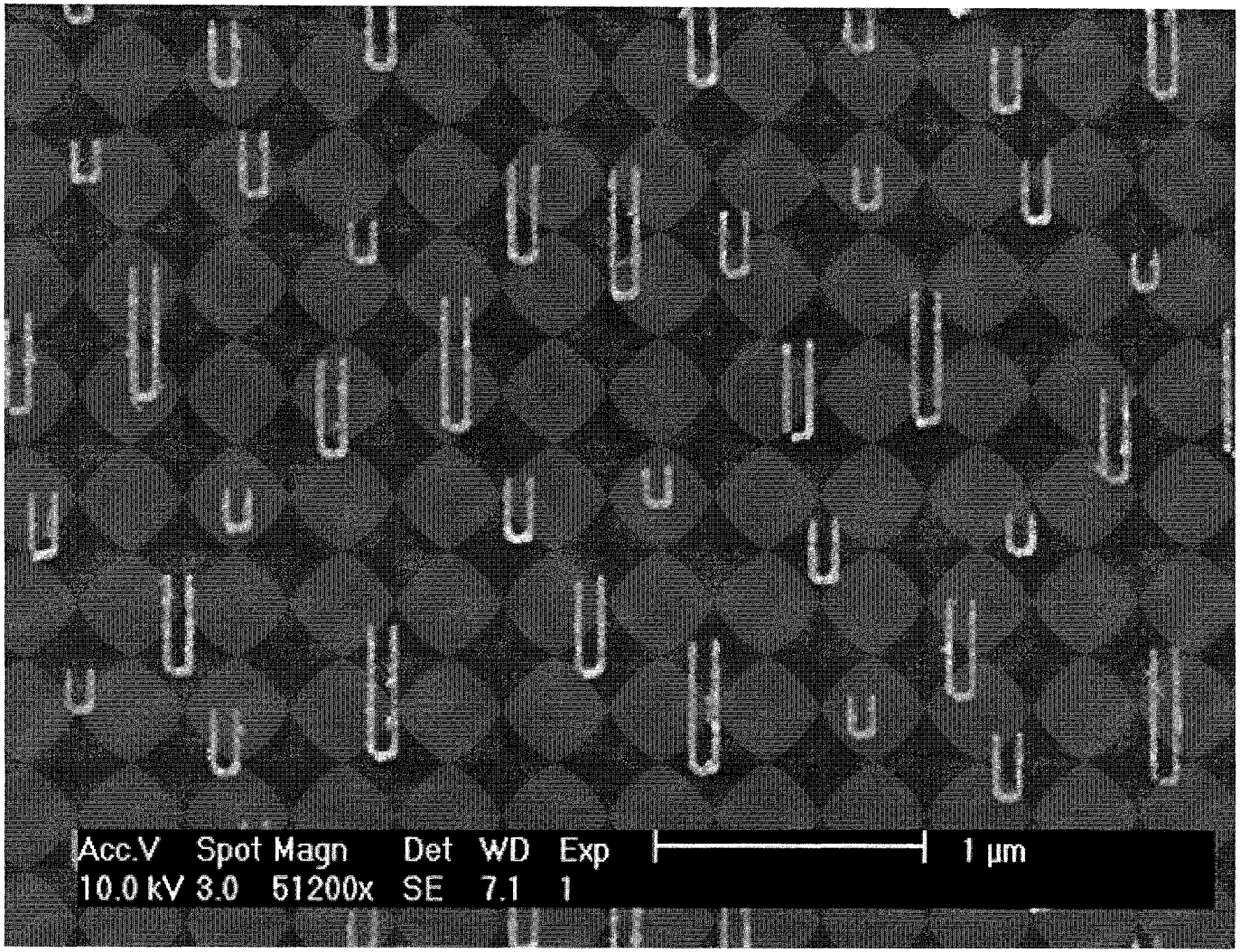
FIGS. 12(*a*)-12(*c*) are electron microscope photographs illustrating various exemplary structures according to embodiments of the present invention.
Figure 12B:
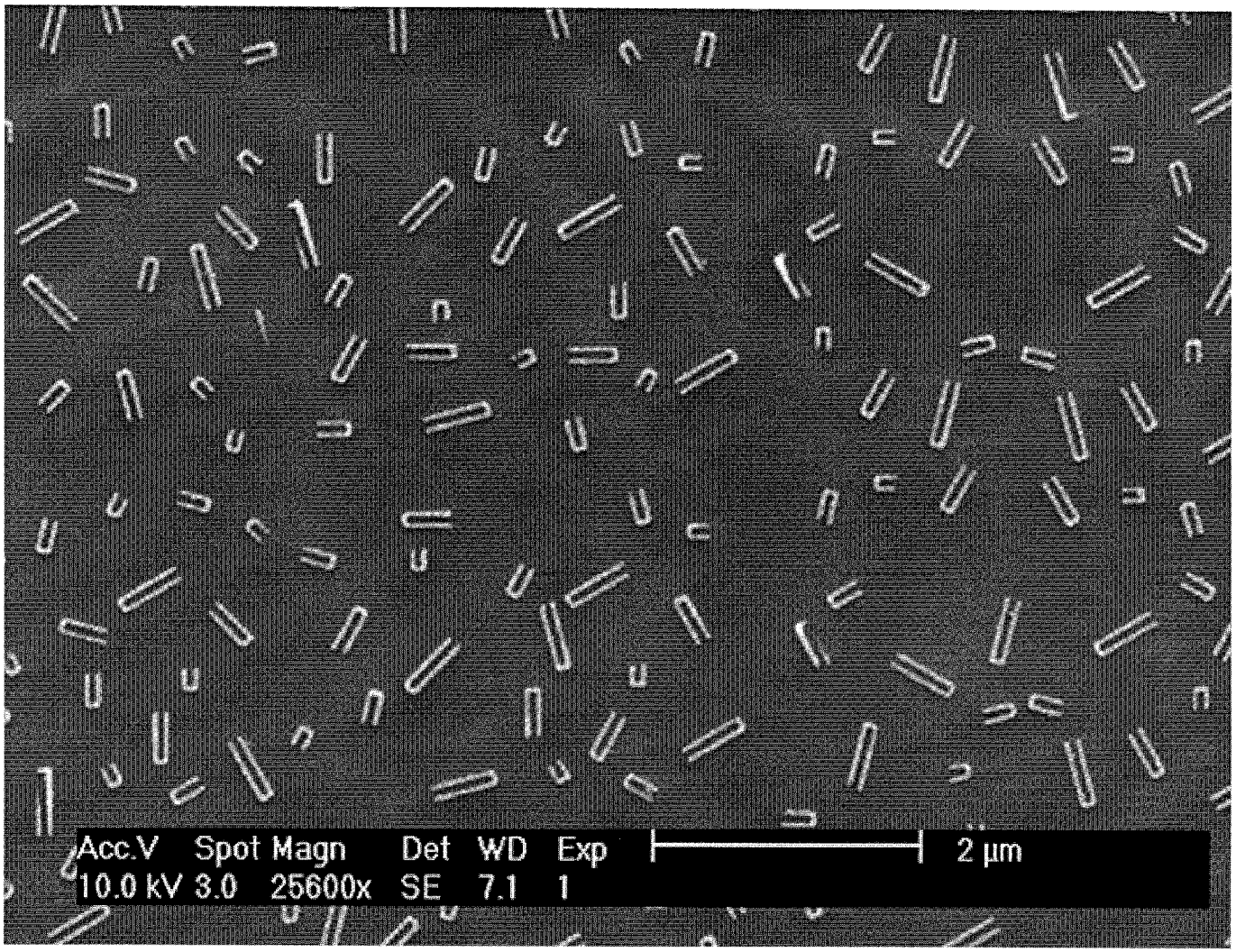
Figure 12C:
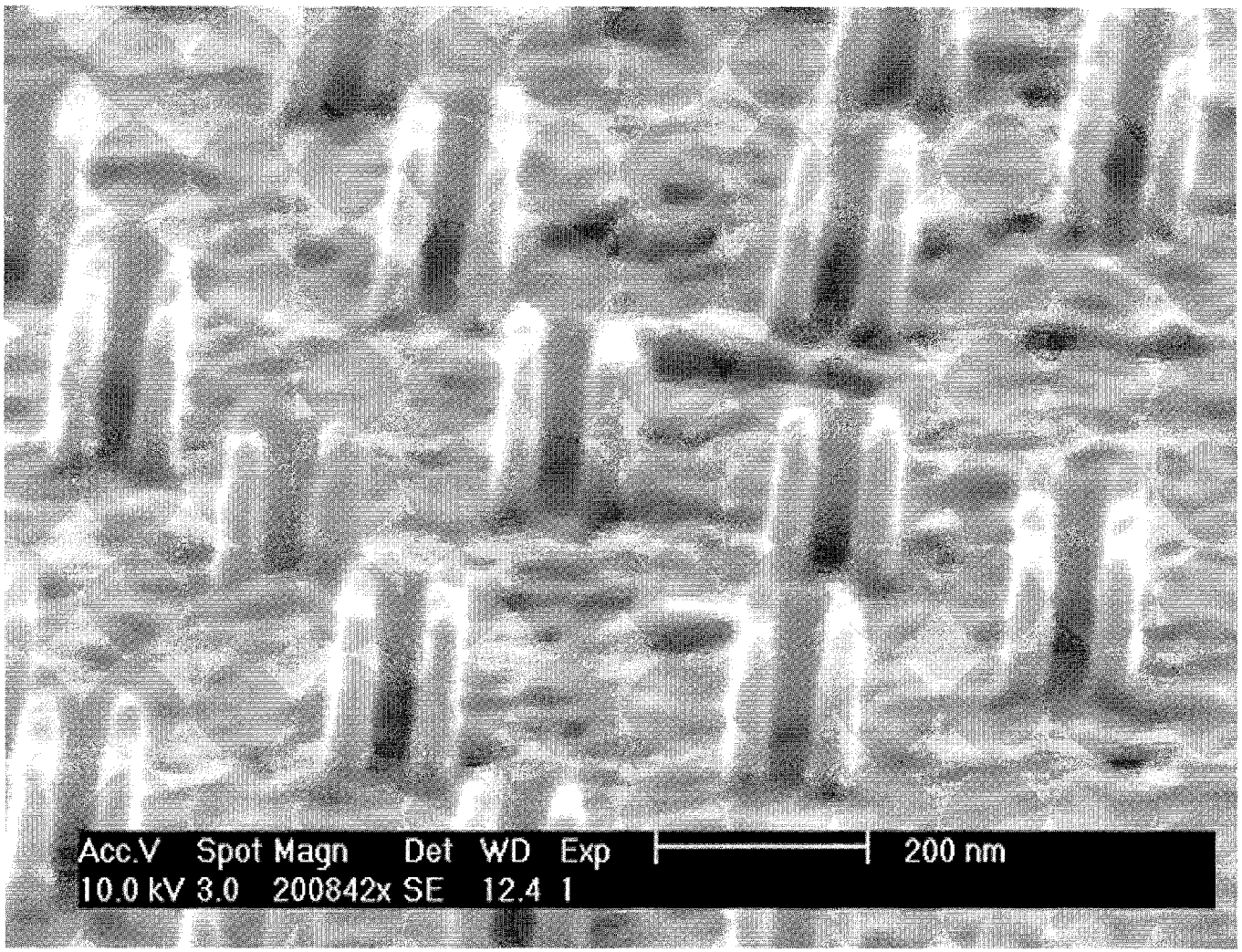

FIGS. 12(*a*)-12(*c*) are electron microscope photographs illustrating various exemplary structures operable according to embodiments of the present invention. Each of the figures shows a number of U-shaped cavity structures formed on a substrate. The structures may be formed, e.g., according to the methods and systems described in related U.S. patent application Ser. No. 10/917,511, filed on Aug. 13, 2004, entitled "Patterning Thin Metal Film by Dry Reactive Ion Etching," and U.S. application Ser. No. 11/203,407, filed on Aug. 15, 2005, entitled "Method Of Patterning Ultra-Small Structures," both of which are commonly owned with the present application at the time of filing.

Thus are described ultra-small resonating charged particle beam modulators and the manner of making and using same.

Below we describe methods for forming an improved, diamond field emission tip that will act as a source of charged particles for use with ultra-small resonant structures. A surface of a micro-resonant structure is excited by energy from an electromagnetic wave, causing the micro-resonant structure to resonate. This resonant energy interacts as a varying field. A highly intensified electric field component of the varying field is coupled from the surface. A source of charged particles, referred to herein as a beam, is provided. The beam can include ions (positive or negative), electrons, protons and the like. The beam may be produced by any source, including, e.g., without limitation an ion gun, a tungsten filament, a cathode, a planar vacuum triode, an electron-impact ionizer, a laser ionizer, a chemical ionizer, a thermal ionizer, an ion-impact ionizer.

The beam travels on a path approaching the varying field. The beam is deflected or angularly modulated upon interacting with a varying field coupled from the surface. Hence, energy from the varying field is transferred to the charged particles of the beam. Characteristics of the micro-resonant structure including shape, size and type of material disposed on the micro-resonant structure can affect the intensity and wavelength of the varying field. Further, the intensity of the varying field can be increased by using features of the micro-resonant structure referred to as intensifiers. Further, the micro-resonant structure may include structures, nano-structures, sub-wavelength structures and the like, as are described in the above identified co-pending applications which are hereby incorporated by reference.

An improved charged particle emission tip includes diamond as one of the principle tip materials, together with a highly conductive metal as an improved charged particle source.

Figure 1:
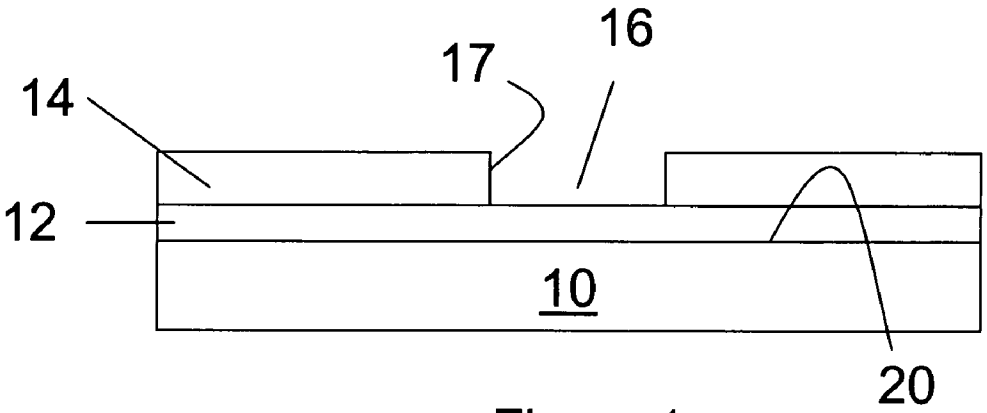
FIG. 1 shows a diagrammatic cross-section of a first step in the production cycle of a first embodiment of the present invention.

In manufacturing such a field emission tip, a substrate material 10, such as silicon as shown in FIG. 1, provides a starting base layer. A diamond layer 12 is then formed on or deposited, typically by using a chemical vapor deposition (CVD) technique, on the upper surface 20 of the substrate 10. Thereafter, a layer of photoresist 14 is formed at discrete locations on, or across the entire upper exposed surface of diamond layer 12.

Figure 2:
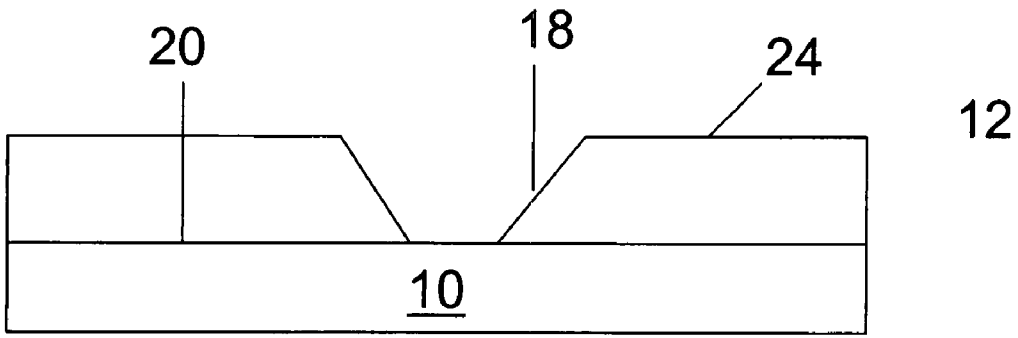
FIG. 2 shows a diagrammatic cross-section of the next step in the production cycle of a first embodiment of the present invention.

The "photoresist" layer 14 is then patterned, as shown in FIG. 2, by using one or more etching techniques, including, for example, isotropic etching, RIE etching techniques, lift off or chemical etching techniques, to form holes having vertical sidewalls 17. This is followed, as shown in FIG. 2, by etching the diamond layer using, for example, a reactive ion etch that is tuned to provide an isotropic etch as is known to those skilled in the art. It is preferred to completely etch through the full height of the diamond layer 12 down to the substrate's upper surface 20. It is also preferred to form the etched holes in the diamond layer 12 with angled side walls 18, for example at a discrete angle to the substrate's upper surface 20 which is thereby exposed in that etched opening. This angle of side walls 18 relative to the upper surface 20 will preferably range from about 91° to about 135°, with the preferred range of angles being 95° to 120°.

Figure 3:
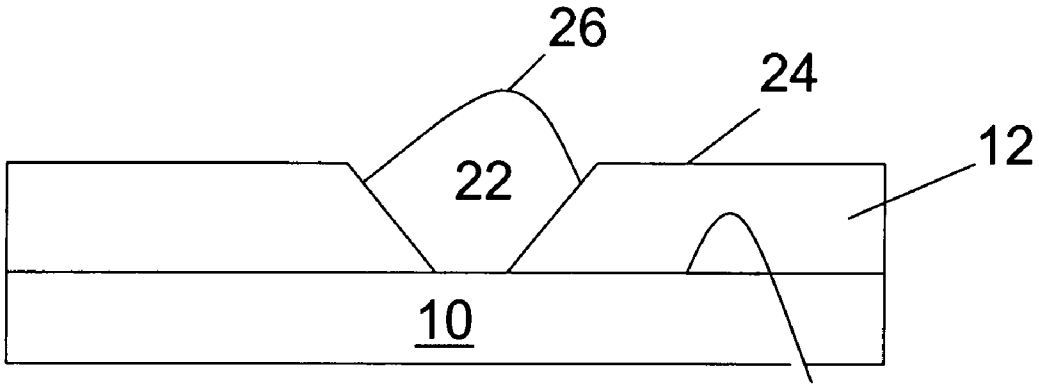
FIG. 3 shows a diagrammatic cross-section of the next step in the production cycle of a first embodiment of the present invention.

A conductive material, such as, for example, silver (Ag) 22, is then preferably electroplated into the etched patterned areas of the diamond layer 12 as shown in FIG. 3. Other deposition techniques could be used as well, so long as the desired amount of silver, or other conductive metal, is deposited. It is preferred to have the deposited silver 22 remain within the vertical confines of the patterned areas within the diamond layer 12 and that the silver not migrate onto or across the top surface 24 of the diamond layer 12. The silver will typically extend above the surface of the diamond layer when the hole is completely filled. It is desired to nearly fill the hole, leaving the edge 34 at least slightly exposed. That way, edge 34 will comprise the emission edge or tip. The shape of the extended portion 26 of the deposited silver 22 can be one of a variety of shapes including curved, polygonal, spherical or other shape. Regardless of the exact shape of the extending portion of the conductive material, what is desired is that some volume of the deposited material, such as the silver material 22, extend above the horizontal level of diamond surface 24. It is also desirable that the conductive material 22 come as close as possible to the upper edge 34 of the diamond material 12.

Figure 4A:
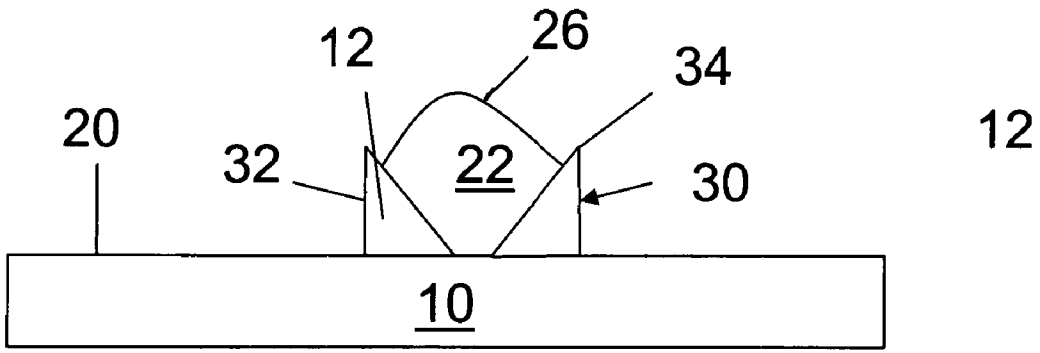
FIG. 4A shows the results of etching a diamond layer during the formation of diamond emission tips according to a first embodiment of the present invention.

Following the electroplating of the conductive material, e.g., the silver 22, the diamond layer 12 will be further etched, for example by plasma etching, to cut away the diamond material 12 close to the deposited material thus forming the side wall 32 of the diamond layer and forming as well the shaped structure 30. This structure 30 can be formed into a number of shapes including, for example, a circular collar or ring that extends around and is in tight contact against the conductive material, silver 22, as is shown in FIG. 4A. As noted above, the structure 30 can be segmented rather than a continuous structure, with the segments be of any desired shape or portion of the total structure.

The outer side walls 32 of the resulting final shape 30 will preferably be formed at 90° to the surface 20 of the substrate 10, and the upper edge 34 of the diamond structure 30 preferably extends only a part of the way up the total vertical height of the deposited silver 22 and will comprise the edge, line or tip from which emissions will occur.

Figure 4B:
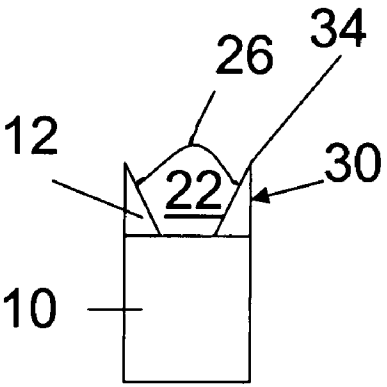
FIG. 4B shows a completed diamond field emission tip from the structure of FIG. 4A.

Thereafter, the substrate 10 will be cut into individual, separate pieces thereby forming finished individual emission tips each of which being comprised of the silver material 22, the diamond material 30 surrounding at least the base of the silver material 22 and the underlying substrate 10 as is shown in FIG. 4B.

Figure 5:
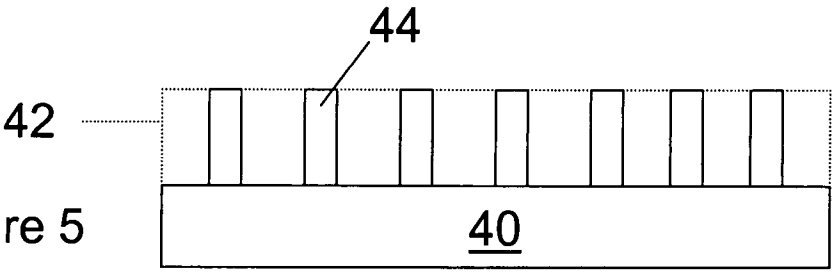
FIG. 5 shows a diagrammatic cross-section of a first step in the production cycle of a second embodiment of the present invention.

A second method of forming diamond field emission tips begins with a substrate 40 of typically silicon on which a diamond layer 42, shown by the dotted lines in FIG. 5 was formed by being deposited, for example, by CVD techniques. The diamond layer 42 is thereafter suitably patterned by depositing a layer of a photoresist or e-beam resist material, such as PMMA, and which is then patterned by one or more of the techniques mentioned above. Optionally, and intermediate hard mask of material, such as $SiO_2$ or metal may be used. The diamond layer is then etched by using typically oxygen plasma etching techniques. When the photoresist is removed this process will have created a plurality of vertically extending, separated, individual diamond posts 44, shown in FIG. 5 in full line. Each diamond post 44 can have any shape that is desired and constructed by the pattern chosen, and the shape can be arbitrary as long as an edge, corner, tip or other sharp area is created from which the emissions will occur. The height can range from about 100 nm to about 1000 nm, and a width ranging from about 100 nm to about 500 nm, although these dimensions are not to be construed as limiting, but are rather only exemplary in the context of this invention.

Figure 6:
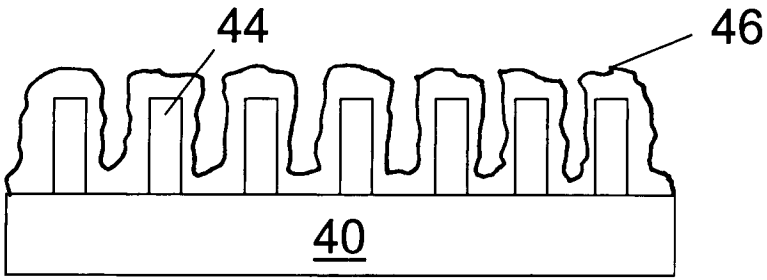
FIG. 6 shows a diagrammatic cross-section of a first step in the production cycle of a second embodiment of the present invention.

With reference to FIG. 6, a layer of highly conductive metal 46, for example, silver (Ag), is then deposited or otherwise formed on and around the diamond posts 44, for example, by employing sputter deposition process, thereby covering them with a metal layer preferably about 100 nm thick. The layer 46 can be shaped to extend around the posts 44 or layer 46 can undulate over and around the diamond posts 44.

Figure 7A:
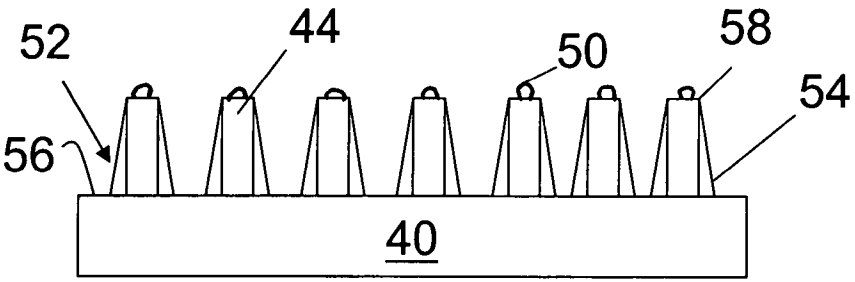
FIG. 7A shows a diagrammatic cross-section of a metal layer etching step in the production cycle of a second embodiment of the present invention.

As shown in FIG. 7A, following the step of depositing the conductive metal layer 46, an etching process, for example slightly anisotropic reactive ion etching, will be used to remove selected portions of metal layer 46 so that a portion 50 remains on the top surface 48 of posts 44, and a triangular cross-sectional shaped portion 52 extends about the outer circumference of each of the posts 44. The remaining conductive metal layer 46 preferably extends from a position adjacent the upper edge of the posts 44, leaving the upper edge 58 of the diamond exposed, down to and in contact with the top surface of substrate 40. It is preferred to have the outer wall 54 of the roughly triangular portion 52 form an angle between the top surface 56 of substrate 40 and the outer wall 54 ranging from about 95° to about 120°. Similarly, the metal 50 remaining on the outer ends of posts 44 can have a spherical, triangular, rounded or other shape. However, it should be understood that the metal structure 52 could have other shapes, such as, for example, and that structure could also be either fully enclosing the outer circumference of posts 44 or could extend around posts 44 in a segmented manner.

Figure 7B:
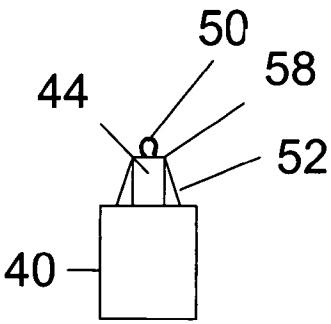
FIG. 7B shows a completed diamond field emission tip from the structure of FIG. 7A.

In the end, the final structure is formed as shown in FIG. 7B where the metal structure 52 is formed about the sides of the diamond posts 44 substantially in the form of a triangular cross-sectional structure, as well as a small amount of metal 50 on the exposed top surface of the posts 44 along with the exposed upper edge 58 which will act as the emission edge or area. Preferably, there will be more metal adjacent the base of the posts 44 than there is near the top of the posts.

Following the completion of the formation steps, the substrate will be cut apart thereby forming individual diamond emission tips as in FIG. 7B.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A system for detecting incoming electromagnetic radiation, comprising:

a diamond field emission tip to provide a beam of charged particles, the tip comprising:

a substrate, a diamond structure in contact with the substrate, and a conductive metal structure in contact with the diamond structure and the substrate; and an ultra-small resonant structure inducing a varying electric field interacting with the incoming electromagnetic radiation having a frequency in excess of the microwave frequency and embodying at least one dimension that is smaller than the wavelength of visible light, whereby said beam of charged particles from the diamond field emission tip passes by the ultra-small resonant structure and is modulated by interacting with said varying electric field as it passes by the ultra-small resonant structure.

2. The system as in claim 1 wherein the diamond structure encloses the conductive metal.

3. The system as in claim 2 wherein the conductive metal extends outwardly beyond the diamond structure.

4. The system as in claim 3 wherein the outwardly extending portion of the conductive metal has a curved outer shape.

5. The system as in claim 2 wherein the diamond structure completely encircles the conductive metal.

6. The system as in claim 2 wherein the diamond structure includes a conically shaped interior recess in which the conductive metal is contained.

7. The system as in claim 1 wherein the conductive metal encloses at least a portion of the diamond structure.

8. The system as in claim 7 wherein the conductive metal is defined by an angled exterior sidewall.

9. The system as in claim 1 wherein the diamond structure comprises an upstanding post.

10. The system as in claim 9 wherein the conductive metal substantially encircles the diamond structure.

11. The system as in claim 9 wherein the diamond post has an upper surface and further including a second conductive metal structure positioned on the upper surface.

12. The system of claim 1 wherein said ultra-small resonant structure is a cavity.

13. The system of claim 1 said ultra-small resonant structure is a surface plasmon resonant structure.

14. The system of claim 1 wherein said ultra-small resonant structure is a plasmon resonating structure.

15. The system of claim 1 wherein said ultra-small resonant structure has a semi-circular shape.

16. The system of claim 1 wherein said ultra-small resonant structure is symmetric.

17. The system of claim 1 wherein said varying electric field of said resonant structure modulates the angular trajectory of said electron beam.

18. The system of claim 1 wherein said varying electric field of said ultra-small resonant structure modulates the axial motion of said electron beam.

19. The system of claim 1 wherein said resonant structure is a cavity filled with a dielectric material.

20. The system of claim 1 wherein said charged particles are selected from the group comprising: electrons, protons, and ions.

21. The system of claim 1 wherein said ultra-small resonant structure is constructed of a material selected from the group comprising: silver (Ag), copper (Cu), a conductive material, a dielectric, a transparent conductor; and a high temperature superconducting material.

22. The system of claim 1 wherein said ultra-small resonant structure comprises a plurality of ultra-small resonant structures.

* * * * *